United States Patent [19]

Post

[11] 4,223,589

[45] Sep. 23, 1980

[54] DOUBLE-FEED SPROCKET ARRANGEMENT FOR MUNITION CHANGING IN AUTOMATIC GUNS

[75] Inventor: Lothar Post, Duesseldorf, Fed. Rep. of Germany

[73] Assignee: Rheinmetall GmbH, Duesseldorf, Fed. Rep. of Germany

[21] Appl. No.: 973,105

[22] Filed: Dec. 26, 1978

[30] Foreign Application Priority Data

Dec. 23, 1977 [DE] Fed. Rep. of Germany ..... 2757663

[51] Int. Cl.[3] ..... F41D 10/16

[52] U.S. Cl. ..... 89/33 SF; 89/33 CA

[58] Field of Search ..... 89/33 BA, 33 BC, 33 CA, 89/33 SF

[56] References Cited

U.S. PATENT DOCUMENTS

| | | | |
|---|---|---|---|
| 2,851,927 | 9/1958 | Smith | 89/33 CA X |
| 3,227,787 | 10/1966 | Brieger | 89/33 SF X |
| 3,611,869 | 10/1971 | Hupp | 89/33 CA X |
| 3,662,646 | 5/1972 | O'Brien et al. | 89/33 SF |
| 4,015,511 | 4/1977 | Folsom et al. | 89/33 SF |
| 4,069,740 | 1/1978 | Hottinger et al. | 89/33 SF |
| 4,119,012 | 10/1978 | Frye | 89/33 CA X |

*Primary Examiner*—Peter A. Nelson

[57] ABSTRACT

An improved double-feed arrangement for introducing munition shells into the breech of an automatic weapon such as a machine gun. The double-feed arrangement includes a housing having two munition belt inlet openings and two munition belt outlet openings respectively equidistantly disposed from the longitudinal axis of the automatic weapon. A pair of hollow transport shafts rotatable in said housing and adapted to be selectively driven by a driving mechanism which can be energized by the recoil of the automatic weapon. A sprocket wheel having a plurality of equidistantly spaced shell receiving seats is mounted on each hollow transport shaft. The sprocket wheels are adapted to normally rotate in mutually opposite directions in a stepwise manner except when a selective switching from one feed to the other feed if effected, whereby a rotational step is imparted on both feeds by the driving mechanism via switching mechanisms to effect a rotation in the same direction. The shell of a first type is then moved from a firing chamber introducing position to a waiting position while the shells of a second type are now stepwise fed into the firing chamber introducing position by the other feed.

3 Claims, 5 Drawing Figures

DOUBLE-FEED SPROCKET ARRANGEMENT FOR MUNITION CHANGING IN AUTOMATIC GUNS

BACKGROUND OF THE INVENTION

The invention relates to a double-feed sprocket arrangement for feeding different types of ammunition to the breech of an automatic weapon, such as a machine gun.

Selectable dual feed of ammunition into the breech of a single barrel machine gun so that the gunner may select either one of two types of ammunition is already known in the art. Such a selectable dual feed arrangement for ammunition has obtained considerable significance in recent weapon technology. It is desirable to obtain a switching of the dual feed ammunition arrangement with as little delay as possible. The known arrangement of the afore-described type do provide for a rapid switching operation. However, the known arrangements have several significant drawbacks, which are as follows:

The known arrangements are quite complex and consequently costly to manufacture. Moreover, the cartridge shell which has been positioned in line with the breech, that is between the two sprocket wheels of the dual ammunition feed arrangement, must be fired or, if a displacement from the chamber introduction position to a waiting position is possible, the afore-mentioned shell cartridge can only be moved to the waiting position in a very cumbersome manner.

The type of dual feed arrangement for ammunition for a machine gun wherein the shell cartridge positioned in the middle position for introduction into the firing chamber cannot be returned to the waiting position, is for example described in German published patent application No. 24 15 141. In the dual ammunition feed arrangement of the afore-mentioned German published patent application the guide means for positioning the shell cartridge in the middle position in which it can be introduced into the firing chamber in a direction along the longitudinal axis of the weapon, requires also an extraction position which is transversely displaced with respect to the middle position. As a consequence, this arrangement has the additional drawback of requiring a considerable axial length.

An example of guide means for returning a shell cartridge from the middle introducing position (that is a position from which the shell cartridge is introduced into the firing chamber) back into a waiting position is described in U.S. Pat. No. 3,662,646. In this arrangement disadvantageously, the shell cartridge can only be removed in a complex manner.

Both of the afore-described arrangements have the common disadvantageous feature, which has already been described hereinabove, namely of requiring a very cumbersome and complex construction.

SUMMARY OF THE INVENTION

It is an object of this invention to provide a dual ammunition feed for automatic weapons, such as machine guns of the afore-described type, wherein the drawbacks of the dual ammunition feed arrangements of the state of the art are avoided or mitigated.

It is another object of the invention to provide a dual ammunition feed arrrangement wherein the shell cartridges can be returned from the middle introducing position and these returned shell cartridges can also be removed in a simple manner from the weapon.

The afore-described object of the invention which renders a significant technical advance in the state of the art, requires only a minor constructional height and width, that is the entire arrangement is relatively of small size compared to the total size of the automatic weapon. This result is achieved advantageously by a construction wherein a considerable number of parts of the switching arrangement are disposed in a hollow transport shaft and are thereby protected to a considerable degree. This also provides for a reliable operation with reduced delay in the switching operation itself.

BRIEF DESCRIPTION OF THE DRAWINGS

These and other objects, features and advantages will be apparent from the following specification thereof taken in conjunction with the accompanying drawing in which a preferred embodiment is illustrated, the constructional advantages of which will be described hereinafter.

THE PREFERRED EMBODIMENT

Figure 1:
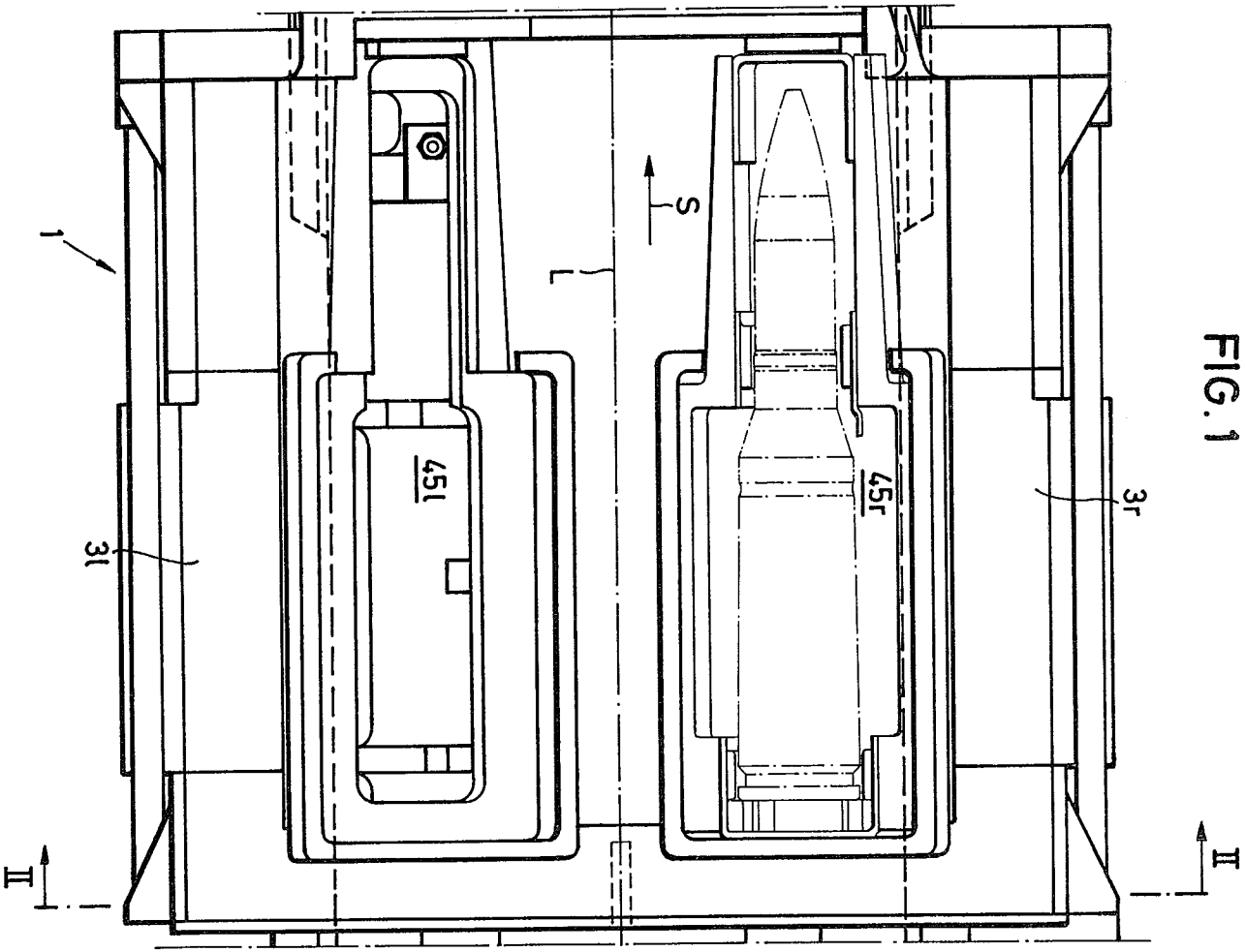
FIG. 1 is a top plan view of a feeder embodying this invention.
Figure 2:
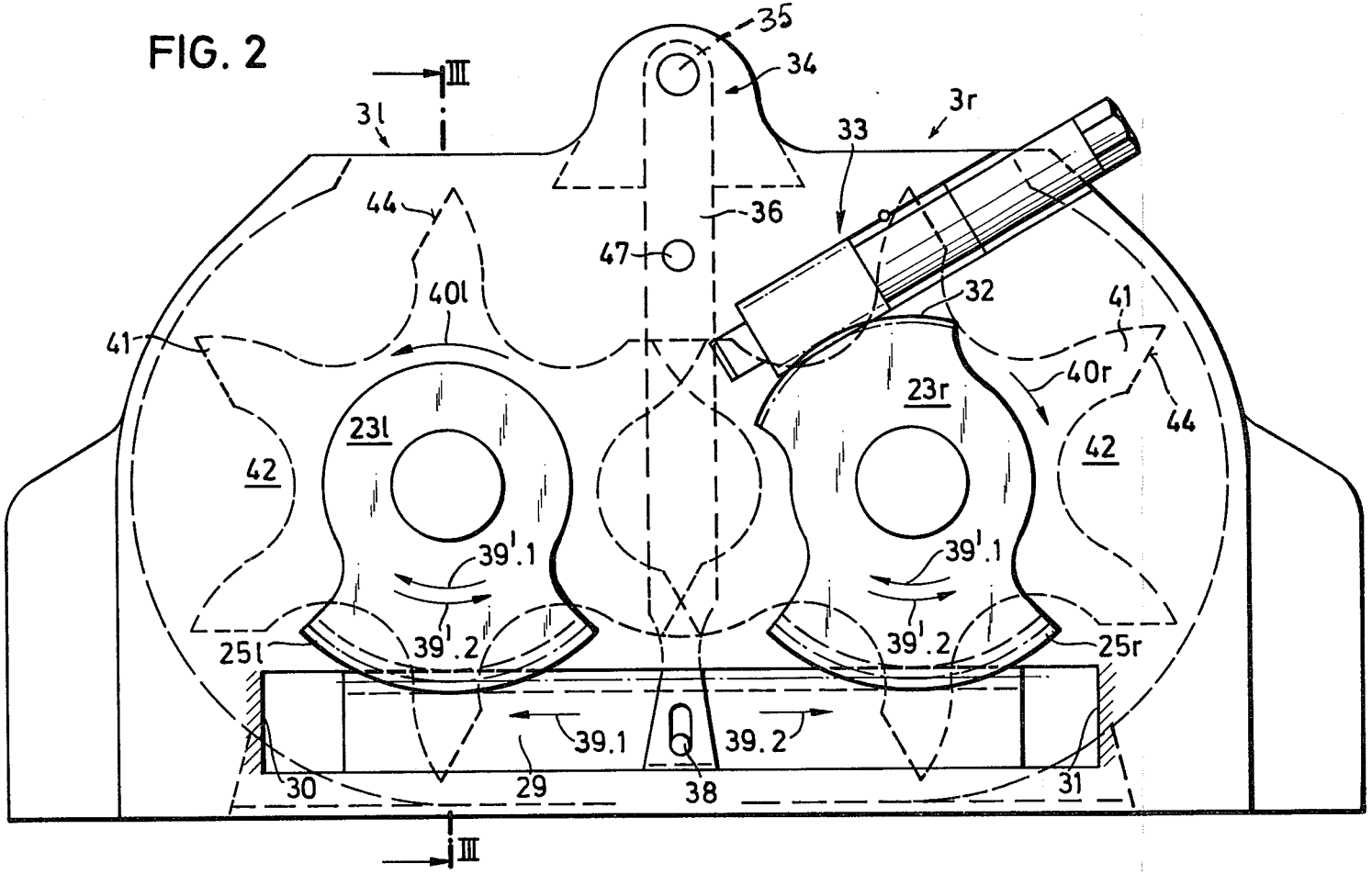
FIG. 2 is an aft view in elevation of the feeder of FIG. 1, along lines II—II.
Figure 3:
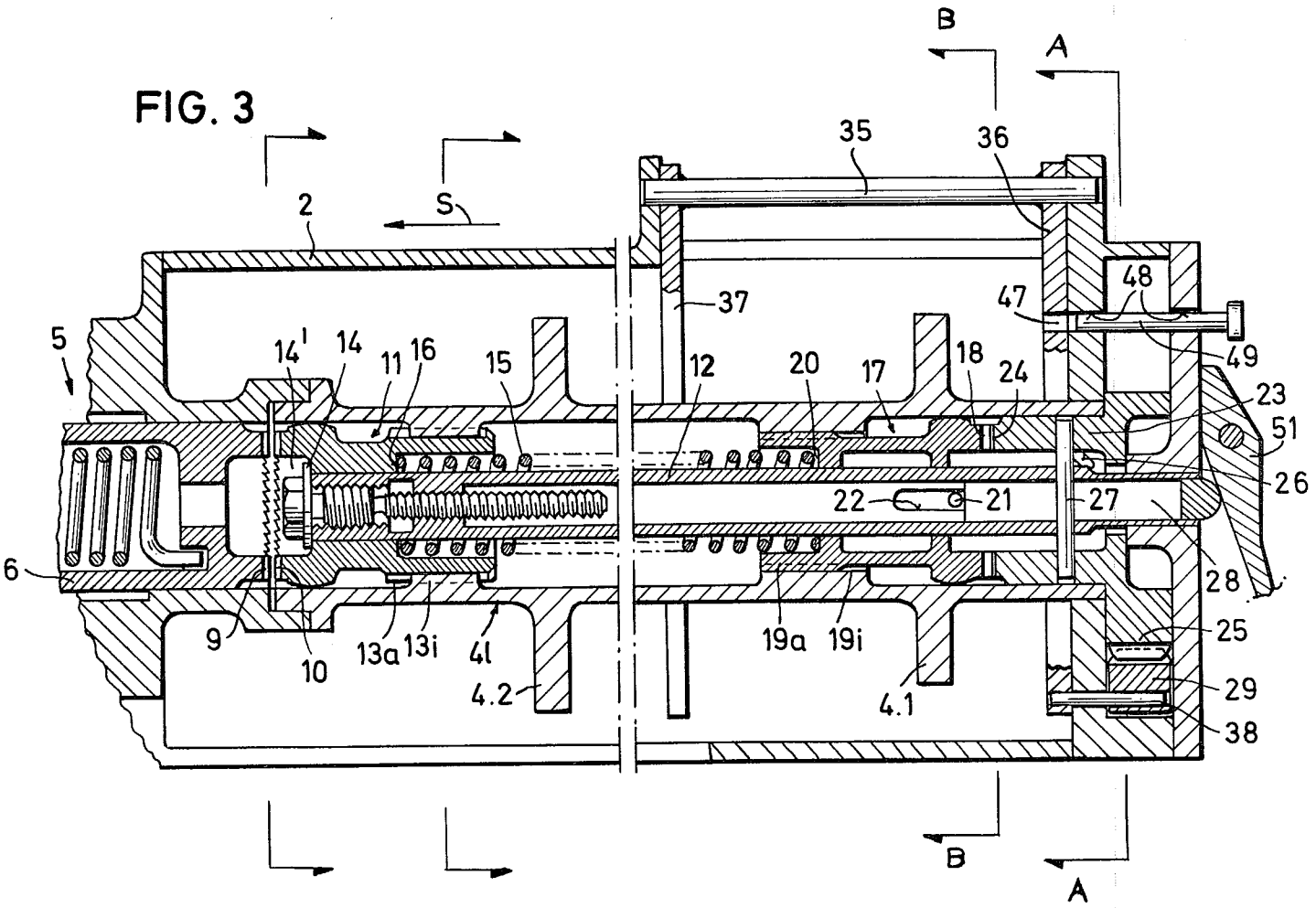
FIG. 3 is a sectional view along line III—III of FIG. 2.
Figure 4:
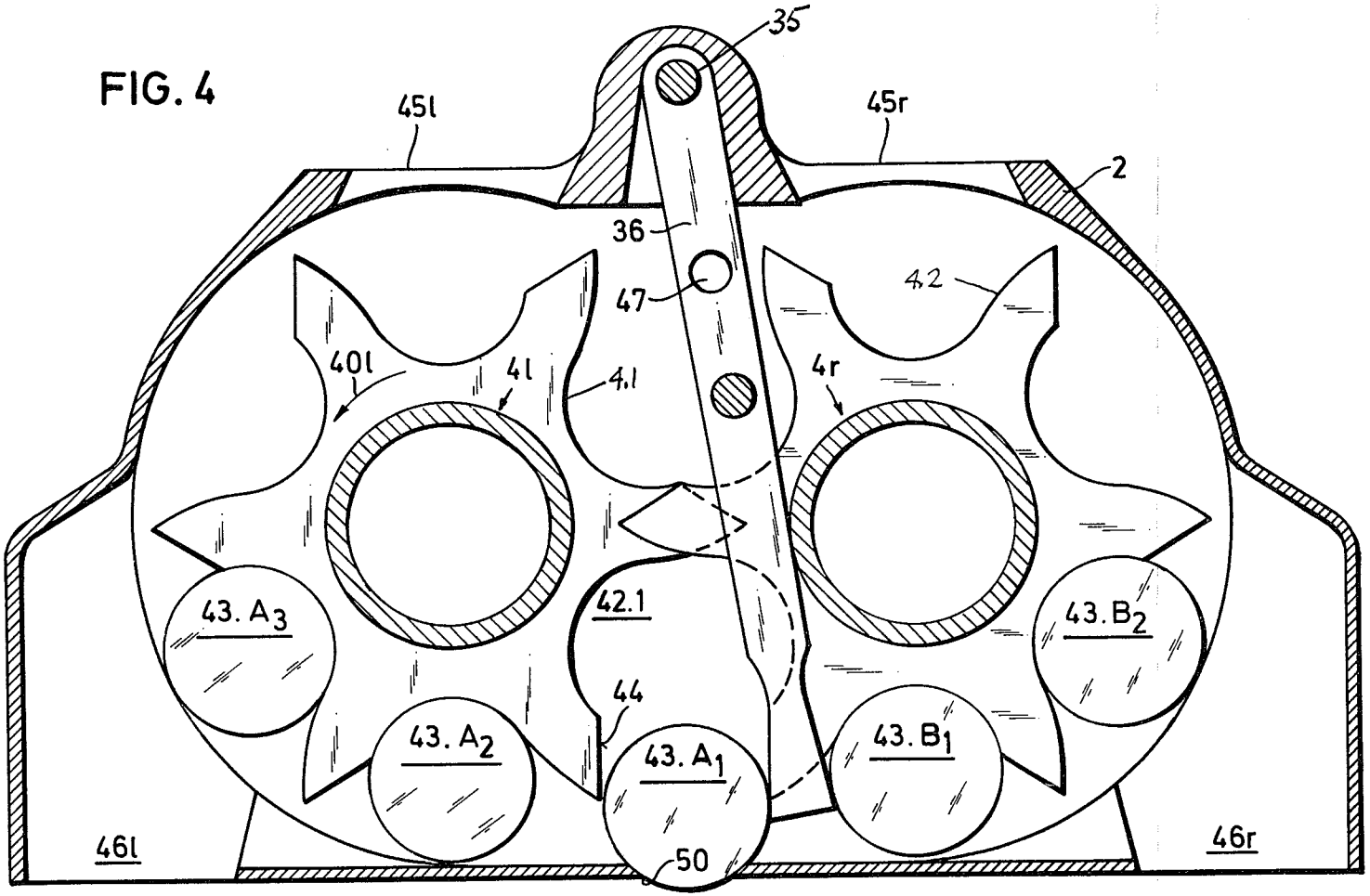
FIG. 4 is a cross-sectional elevational view along a plane parallel to the line II—II of FIG. 1, but positioned forwardly of the plane defined by line II—II of FIG. 1 for purposes of illustrating the manner of operation of the feeder of this invention.
Figure 5:
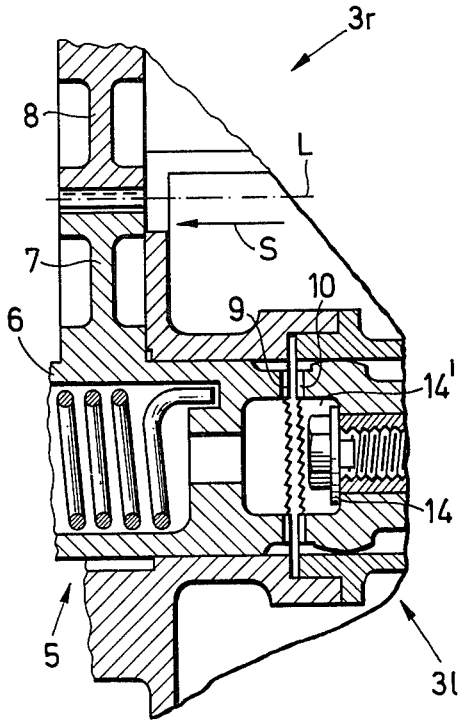
FIG. 5 is a partial sectional view showing a constructional detail of the driving region of the guide arrangement in a top plan view, the plan of the view being parallel to the longitudinal axis of the weapon.

The feeder herein shown and described includes opposed feed sprocket wheels 4.1 and 4.2 which are rotatably mounted in a housing 2 on a pair of parallel hollow rotatable shafts 4 *l*, 4 *r* (FIG. 4). The housing 2 is provided with a left and right feeder, respectively designated 3 *l*, 3 *r*, for permitting the introduction of two separate ammunition belts on which shell cartridges of two different types are respectively mounted. Since the two feed and guide arrangements for the ammunition belts correspond substantially to each other in a mirror-like manner, the following description pertains and refers to both a left and right guiding and feed arrangement taking this mirror-like relationship into consideration. In the drawing the parts pertaining to the left feed and guiding arrangement have been designated with reference numerals including the letter "l" and the corresponding parts in the right guiding and feed arrangement have the same reference numerals with the additional letter "r". Each guiding and feed arrangement 3 incorporates a hollow transport shaft 4 on each of which there is respectively mounted the afore-mentioned sprocket wheel 4.1 or 4.2. The driving energy for driving the pair of sprocket feed wheels is transferred by means of a driving arrangement 5 which includes a drive shaft 6 that can be aligned with one of the two hollow transport shafts 4 *l*, 4 *r*. The functioning of these two transport shafts 4 *l*, 4 *r* depends on the direction of the applied rotational torque. In the illustrated example the drive shaft 6 aligns with the hollow transport shaft 4 *l*, whereby the rotational torque is applied in a counterclockwise direction onto the hollow shaft 4 *l*. The drive shaft 6 has a gear wheel 7 coaxially and integrally mounted therewith which meshes with a gear wheel 8 which is therefore driven by the driving arrangement 5. The gear wheel 8 in turn is connected to the coupling half 9. The illustrated drive coupling 9, 10 therefore acts as a ratchet coupling which acts unidirectionally in a counterclockwise direction. The driving coupling half 9 is operatively connectable to the drivable coupling half 10 by means of a switching member 11 which is mounted on the end face of the transport shaft 4. The switching member 11 encompasses one end of a switching shaft 12 and further has at its outer periphery a splined toothing 13*a* for coaction with a splined toothing 13*i* disposed at the interior of the hollow transport shaft 4. A bolt 14' presses by means of a washer 14 against the switching member 11 which is in turn pressed via its end face 16 in the opposite direction by the action of a coil spring 15 coaxially mounted on the hollow shaft 12. The coil spring 15 surrounds the hollow shaft 12 and has one end abutting against a stop surface 20 of a coupling member 17 while the other end abuts, as has been described hereinabove, against the stop surface 16 of the coupling member 11. The coupling member 18 has a splined toothing 19*a* which meshes with a splined inner toothing 19*i* of the transport shaft 4. The coupling member 17, also referred to as a switching member, furthermore has an entraining pin 21 which projects into a slot 22 of the switching shaft 12. The right end of the switching shaft 12 is surrounded by a further switching member 23 having an inner end coupling half 24 which coacts with a coupling half 18 of the adjacent switching member 17. The coupling 18, 24 is a ratchet type coupling and only can produce a rotational torque in a clockwise direction, that is in a rotational opposite direction to the rotational actuating direction of the drive coupling 9, 10. At the right exterior end region of the switching member 23 there is provided a toothed segment 25 which meshes with a toothed rack 29. The latter is movably mounted transversely to the longitudinal axis of the weapon and its transverse movement is limited by a left stop 30 and a right stop 31. The switching member 23 has interiorly a guide notch 26 for coacting with a guide element 27 which is mounted on the switching shaft 12. The switching member 23 which coacts with the right transport shaft 4 *r* has in its exterior end region a toothed segment 32 which meshes with a worm 33 (FIG. 2). Midpoint between the feed and guide arrangement 3 *l* and 3 *r* is disposed a guide element 34. This guide element has an exterior part 36 and an interior part 37 (FIG. 3) which are constructed as free arms and are rigidly mounted on a shaft 35 which is rotatably mounted in the housing 2. A pin 38 mounted on the outer member 36 and the toothed rack 29 provides for a pivotal motion of the guide element 34 about shaft 35 between the left and right end position. There is provided an ammunition belt 45 for each of the two feeds 3 *l*, 3 *r* of the ammunition feeder. The belts 45 *l*, 45 *r* respectively exit from the housing 2 at the outlets 46 *l*, 46 *r*. Each sprocket wheel 4.1, 4.2 has six teeth 41 between which there are provided transport pockets 42 for receiving the shell cartridges 43 disposed therebetween. The housing 2 having the dual feeders 3 *l*, 3 *r* with ammunition belt openings 45 *l*, 45 *r* also has at its bottom surface an insertion passage 50 for a corresponding element of a non-illustrated straightening and pulling closing member. The insertion passage 50 serves to determine the introducing position of a shell cartridge 46.

The afore-described dual ammunition feeder arrangement of the invention operates as follows:

There is positioned in the left feed arrangement 3 *l* of the dual feed arrangement a non-illustrated ammunition belt carrying shell cartridges 43 of a type of ammunition A. In the right feeder arrangement 3 *r* there is mounted a corresponding non-illustrated ammunition belt for an ammunition of the type B (FIG. 4). In the afore-described operative condition the toothed rack 29 (FIG. 2) is positioned with its right end abutting against the stop surface 31. During a firing cycle with the ammunition of type A, energy is transmitted via the drive mechanism 5 thereby imparting onto the shaft 6 a rotation of a predetermined angular distance (starting from a starting position and referred to hereinafter as a switching step) in a counterclockwise direction. During this movement of the shaft 6 the coupling halves 9 and 10 of the drive coupling 9, 10 are in engagement with each other. There is also a driveable engagement via the splined toothing 13*a*, 13*i* between the driving mechanism 5 and the transport shaft 4. The sprocket wheels 4.1 and 4.2 move in the direction of the arrow 40 *l*, 40 *r* one step, which, in the illustrated example of the sprocket wheel amounts to 60°. Simultaneously the coupling halves 18 and 24 of the holding coupling 18, 24 slip past each other in view of their ratchet-type coupling character. Also in view of the fact that there is between the transport shaft 4 and the switching member 17 a splined toothing connection 19*a*, 19*i*, a direct coupling and rotational torque is produced. After a switching step has been carried out the shaft 6 reverses its rotational movement (into the clockwise direction) returns to the starting position, whereby the coupling halves 9 and 10 of the drive coupling 9, 10 slip past each other in view of their ratchet coupling character. After the afore-described switching step, one of the cartridge shells 43.$A_1$ assumes the introducing position via the insertion passage 50 (this position is illustrated in FIG. 4). In this condition of the automatic weapon it is assumed that it is desired to switch to the right feeder 3 *r* for operating the automatic weapon with the alternate ammunition of the type B. For this purpose the worm 33 (FIG. 2) is actuated in a manner not described in detail herein so that via the toothed segment 32 the switching member 23 *r* is imparted a movement in the direction of the arrow 39'.1. Accordingly, the guide element 34 is pivoted from the position illustrated in FIG. 4 to a position to the left of a vertical plane through the longitudinal axis of the weapon (not illustrated). This movement is carried out by virtue of the fact that the coupling member 23 *r* is rotated about its shaft support in the direction of the arrow 39'.1 thereby moving the splined toothed member 29 in the direction of the arrow 39.1 which in turn causes the guide member 34 to pivot via the pins 38 and 35 and the coupling member 23 *l* to rotate in the direction of the arrow 39'.1. The slideable motion of the splined toothed member 29 towards the left is stopped by the stop surface 30. By the angular motions of the switching members 23 *l*, *r* there results a guiding of the control element 27 in its corresponding guide slots 26 so that the left drive coupling 9, 10 is decoupled and in lieu of it the right drive coupling 18, 24 now becomes operative. The corresponding switching movements are advantageously limited in such a way that for each feeder 3 a complete switching step is achieved. As a consequence of this, the cartridge shell 43.$A_1$ is moved from the introducing position (FIG. 4) into the pocket 42.1 from which it originally was moved into the introducing position, that is it has been returned to the waiting position. This results in a very simple and rapid, complete unloading of an automatic weapon armed with the feeder mechanism of this invention. When the corresponding transport shaft 4 is not coupled via the coupling half 10 with the driving coupling half 9 then the holding coupling 18, 24 which has the task of accepting the belt pulling forces in a direction opposite to the direction of the arrow 40 *l*, respectively 40 *r*, and thereby securely hold the belt in the feeder when the drive coupling 9, 10 either by reversal of movement or in a different way is decoupled and therefore not force-transmitting. The holding coupling 18, 24 can, however, be deactivated by pressing in the safety bolt 28 by means of an safety lever 51 thereby opening the holding coupling 18, 24. Thus, the bolt 28 first presses against the entraining pin 21 fixedly secured to the switching member 17 and displaces the latter along the slit 22 towards the left and against the action of the spring 15. If one of the ammunition belts is to be removed, this can be easily accomplished by moving it against the transport direction 40 via the respective belt inlets 45. That shell cartridge which has not yet been moved from the waiting position into the introducing position can in this way be again removed from the ammunition belt; a shell cartridge 43.$A_1$ as illustrated in FIG. 4 can correspondingly be loosely removed from the belt inlet 45 and out of the pocket 42.

Advantageously an intermediate positipon of the guide element 34 (see FIG. 2) corresponds to a condition in which both transport shafts 4 *l*, r *r* are decoupled from their corresponding drive couplings 9, 10. In the latter case no cartridge shell 43 can be positioned via the insertion passage 50 into the insertion position and both belts can after decoupling of the holding coupling 18, 24 be pulled out of the automatic weapon, whereby by removing a cartridge shell from the introducing position into the waiting position the weapon can be simply and completely unloaded without any further manipulation by removal of the shells through the corresponding belt inlets 45 *r, l*. The arrangement of the invention is advantageously constructed in such a way that the switching device during switching from one type of ammunition feeding to another type of ammunition feeding undergoes a forced and defined movement which is carried out via a transporting step. In this way it is possible, by simply pushing in an adjusting pin 49, slidably and movably mounted in bores 48 in the housing 2, into a bore 47 in the member 36, thereby providing an additional safety against releasse of the introducing position for a shell cartridge 43. The introduction of the pin 49 into the bore 47 provides a blocking of the switching mechanism. The secure blocking of the latter can also be carried out by blocking another one of the forecably driven elements forming the switching drive.

Although the invention is illustrated and described with reference to one preferred embodiment thereof, it is to be expressly understood that it is in no way limited to the disclosure of such a preferred embodiment, but is capable of numerous modifications within the socpe of the appended claims.

What is claimed is:

1. An improved double-feed arrangement for introducing munition shells into the breech of an automatic weapon having a breech block, in particular a machine gun, wherein the double-feed arrangement comprises a housing in which are two feeders respectively operatively mounted equidistantly from the longitudinal axis of said weapon for feeding two different types of shells into the breech of the automatic weapon, each feeder having a hollow shaft rotatably mounted in said housing, a sprocket wheel having a plurality of equidistantly spaced ammunition receiving seats axially mounted on each support shaft, said sprocket wheels being rotatable in mutually opposite directions, a guide means slidably movably mounted in said housing between two end positions in directions transverse to the longitudinal axis of said weapon, a driving mechanism operatively connected to said guide means via a switching mechanism, whereby the guide means is positioned in one of the two end positions by the switching mechanism during a firing cycle to thereby guide a first shell from the receiving seat of the corresponding sprocket wheel of the corresponding feeder into a firing chamber introducing position at which position said first shell can be introduced by the breech block into the firing chamber of the automatic weapon and being adapted to further guide said first shell back into a middle waiting position from the firing chamber introducing position at which position the first shell can not be introduced by said guide means into the firing chamber and further when said switching mechanism is selectively activated to position said guide means in the other end position the guide means are adapted to selectively carry out the aforedescribed steps with respect to second shells of the other feeder, the improvement comprising:

(a) wherein said guide means include an exterior and an interior lever rigidly secured to each other in confronting relationship by means of a shaft which is rotatably mounted in said housing;

(b) said shaft extending parallel to the longitudinal axis of the automatic weapon;

(c) said guide means further including a bar slidably moveable between said two end positions and being operatively connected to said exterior lever;

(d) said first and second shells in said housing being disposed in the receiving seats of the sprocket wheels of the respective feeders with the exception of the shell mounted in the middle position between the two sprocket wheels;

(e) when said switching mechanism is selectively actuated to disable one feeder and activate the other feeder the first shell most proximate to the firing chamber introducing position is returned by said guide means to the receiving seat of the sprocket wheel from which it had been moved into the firing chamber introducing position; said switching mechanism including said pair of hollow transport shafts on which said sprocket wheels are rigidly coaxially mounted, said transport shafts being rotated by said driving mechanism in a stepwise manner and in the same rotational direction during the switching operation from one feeder to the other feeder.

(f) when said exterior and interior lever are in a middle position in which said bar is not in one of said two end positions said guide means permits freedom of reciprocal movement for the breech block.

2. The improved double-feed arrangement for introducing munitions shells as set forth in claim 1, wherein said exterior and interior lever forming part of said guide means when assuming the middle position occupy a substantial portion of the free space between said sprocket wheels which is normally occupied by the shell which is in the firing chamber introducing position.

3. The improved double-feed arrangement for introducing munitions shells as set forth in claim 1 wherein said switching mechanism includes at least one pair of coupling members operatively mounted inside each one of said hollow transport shafts.

* * * * *